US005379482A

United States Patent [19]

Junger

[11] Patent Number: 5,379,482

[45] Date of Patent: Jan. 10, 1995

[54] CLEANING SYSTEM FOR TEXTILE MACHINES

[75] Inventor: Reiner Junger, Friedberg, Germany

[73] Assignee: Ernst Jacobi GmbH, Gersthofen, Germany

[21] Appl. No.: 46,820

[22] Filed: Apr. 16, 1993

[30] Foreign Application Priority Data

Apr. 16, 1992 [DE] Germany ..... 9205280[U]

[51] Int. Cl.[6] ..... B08B 5/04

[52] U.S. Cl. ..... 15/312.1; 15/422.2

[58] Field of Search ..... 15/312.1, 312.2

[56] References Cited

U.S. PATENT DOCUMENTS

| | | | |
|---|---|---|---|
| 2,585,776 | 2/1952 | Hermanek | 15/312.1 X |
| 2,634,560 | 4/1953 | Ramm | 15/312.1 X |
| 3,003,177 | 10/1961 | Hijiya | 15/312.2 |
| 3,018,503 | 1/1962 | Hijiya et al. | 15/312.1 |
| 3,534,658 | 10/1970 | Carsey | 15/312.1 X |
| 3,697,691 | 10/1972 | von Hippel | 15/312.1 X |

FOREIGN PATENT DOCUMENTS

| | | | |
|---|---|---|---|
| 635214 | 3/1962 | Italy | 15/312.1 |
| 1077718 | 8/1967 | United Kingdom | 15/312.1 |

*Primary Examiner*—Chris K. Moore

*Attorney, Agent, or Firm*—Antonelli, Terry, Stout & Kraus

[57] ABSTRACT

A cleaning system for textile machines is comprised of two essentially identical travelling cleaners which can travel separately from one another along a line of textile machines, each of which has a boat-shaped suction nozzle which engages with a stationary suction duct and which is sealed by two sealing lips abutting against the suction nozzle. The suction duct is attached to the suction side of at least one blower, the two essentially identical travelling cleaners engaging their suction nozzles in the suction duct. The suction duct has at least two connections at a distance from one another with which it is attached to the suction side of the at least one blower.

14 Claims, 6 Drawing Sheets

CLEANING SYSTEM FOR TEXTILE MACHINES

FIELD OF THE INVENTION

The invention relates to a traveling cleaning system for textile machines according to the preamble of claim 1.

BACKGROUND TO THE INVENTION

In a known cleaning system of this type, one end of tile suction duct is attached to the suction side of a blower and a travelling cleaner moves along the stationary suction duct. This is used to clean several textile machines arranged in a row. For this purpose, the travelling cleaner has suction hoses which reach into the floor area and draw up the flying fuzz deposited there by the textile machines.

If the travelling cleaner is to avoid traveling over one of the textile machines, for example, due to a machine which requires repair having stopped, then the textile machines ahead of that machine will be cleaned by the travelling cleaner as before, but not, however, those textile machines which are located behind the machine not to be travelled over. Thus, the machines located behind it very quickly become dirty which results in waste.

SUMMARY OF INVENTION

It is an object of this invention to construct a traveling cleaning system in such a way that it is assured that the textile machines located both in front of and behind the textile machine not to be travelled over are cleaned.

In accordance with the present invention a cleaning system for textile machines is comprised of two essentially identical travelling cleaners which can travel separately from one another along a line of textile machines, each of which has a boat-shaped suction nozzle which engages with a stationary suction duct and which is sealed by two sealing lips abutting against the suction nozzle, whereby the suction duct is attached to the suction side of at least one blower, the two essentially identical travelling cleaners engaging their suction nozzles in the suction duct, the suction duct having at least two connections at a distance from one another with which it is attached to the suction side of the at least one blower.

Embodiments of the invention are described in greater detail below with reference to the drawings, in which.

Figure 5:
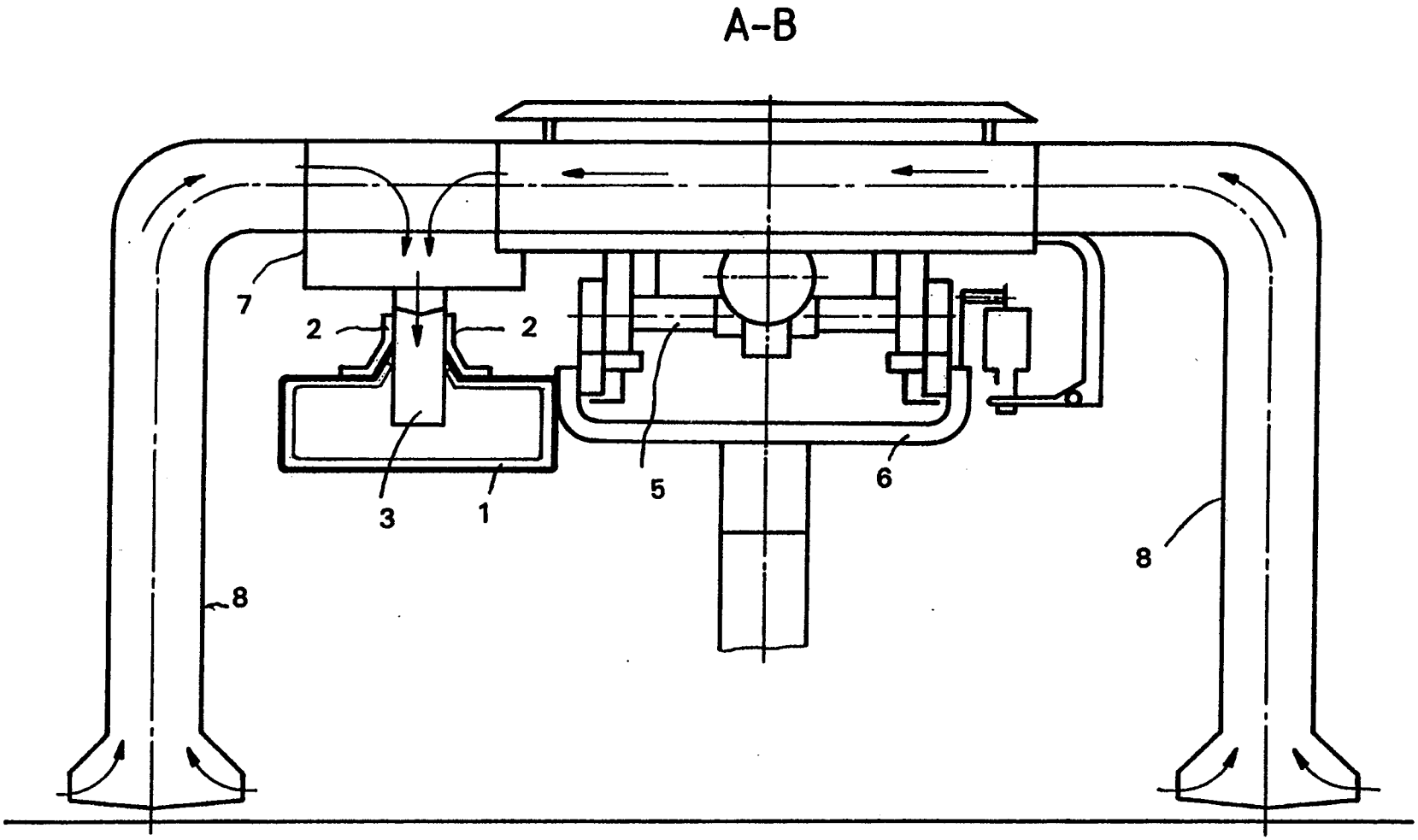
FIG. 5 is a section along the line A–B in FIG. 3.

In the drawings, while the suction duct 1 is illustrated as being extremely short, it usually has the length of the textile machine shop. The suction duct 1, rectangular in cross-section, is provided with a longitudinal orifice at the top which is limited by two resilient sealing lips 2. A boat-shaped suction nozzle 3 of a travelling cleaner 4 engages between each of these two sealing lips 2. Two separately movable travelling cleaners 4 are provided. Each travelling cleaner 4 has a carriage 5 which can move along rails 6 mounted on the textile machines. Each suction nozzle 3 is connected to a distributor box 7 to which two suction hoses 8 are attached whose mouth sweeps over the floor area on both sides of the textile machine. Blowers 10 are each attached with its suction side, via piping 9, to a corresponding end of the suction duct 1, whereby a filter screen 11 is placed between the piping 9 and each blower 10. During operation, air is drawn in via the openings of the suction hoses 8, whereby the air taken in reaches the blowers 10 via the respective distributor box 7, the suction nozzle 3, suction duct 1, tubing 9 and the flying fuzz carried along is separated at the respective filter screen 11. The direction of the suction air is indicated by the arrows in FIGS. 1 and 5.

As already rioted, the two travelling cleaners 4 can be moved separately from one another. If the travelling cleaners 4 are to avoid passing over a textile machine then that textile machine is bypassed by the travelling cleaners 4. However, the textile machines in front of and behind that textile machine are always passed over by one of tile travelling cleaners 4. It is thus assured that all operating textile machines are cleaned.

Figure 1:
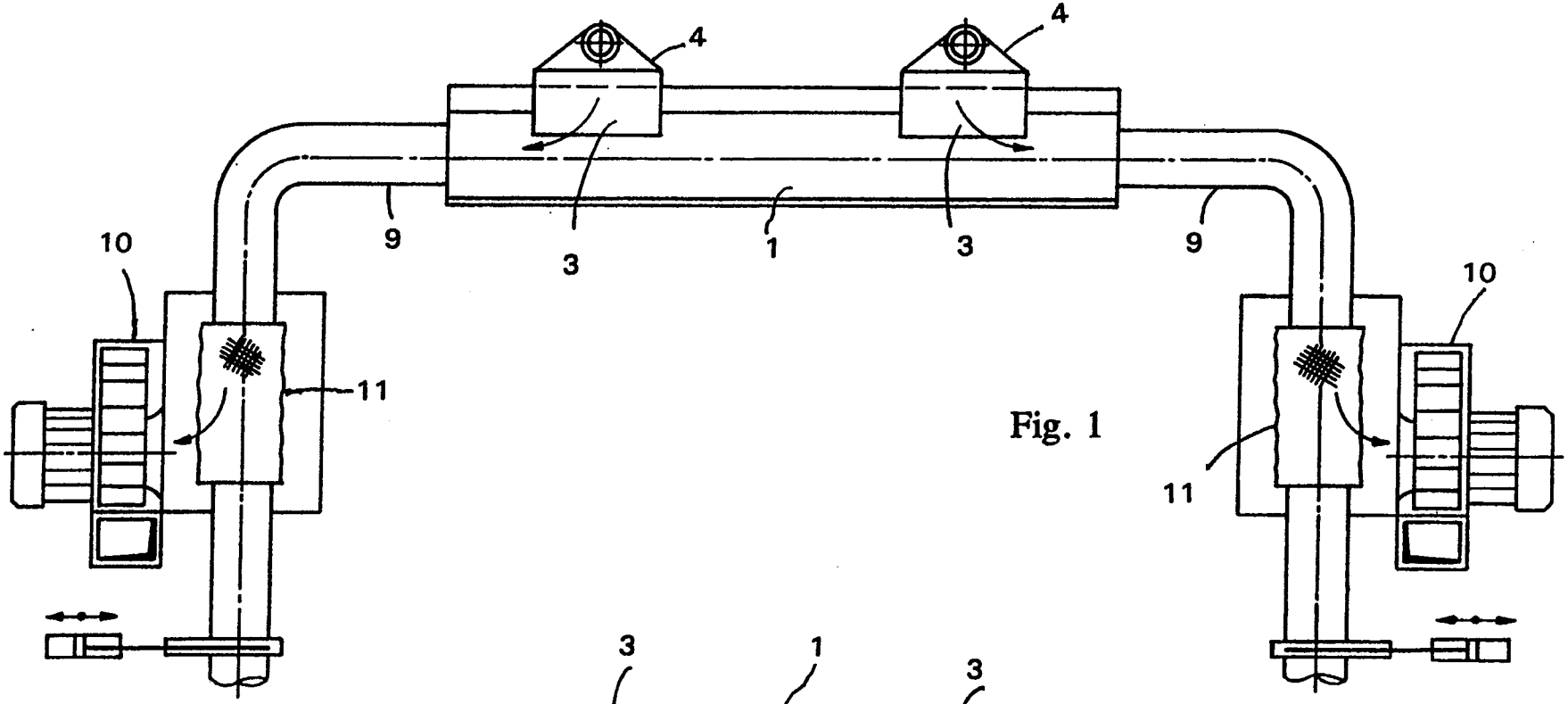
FIG. 1 is a schematic view of a first embodiment of the cleaning system in accordance with this invention.
Figure 2:
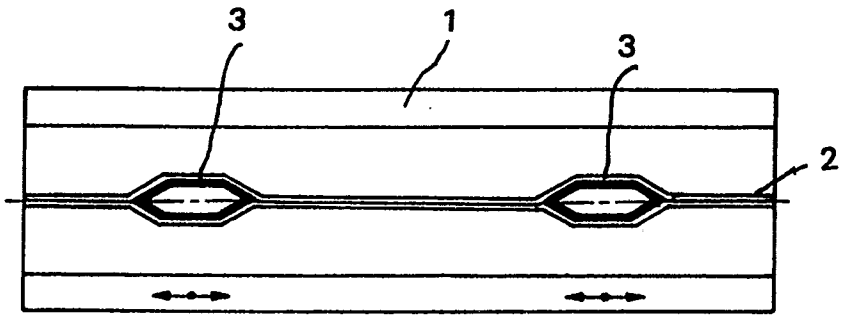
FIG. 2 is a top view onto the suction duct with the suction nozzle engaged there.

In the embodiment of FIG. 1, a blower 10 is attached to each end of the suction duct. Two travelling cleaners 4 engage their suction nozzle in the suction duct 1.

Figure 3:
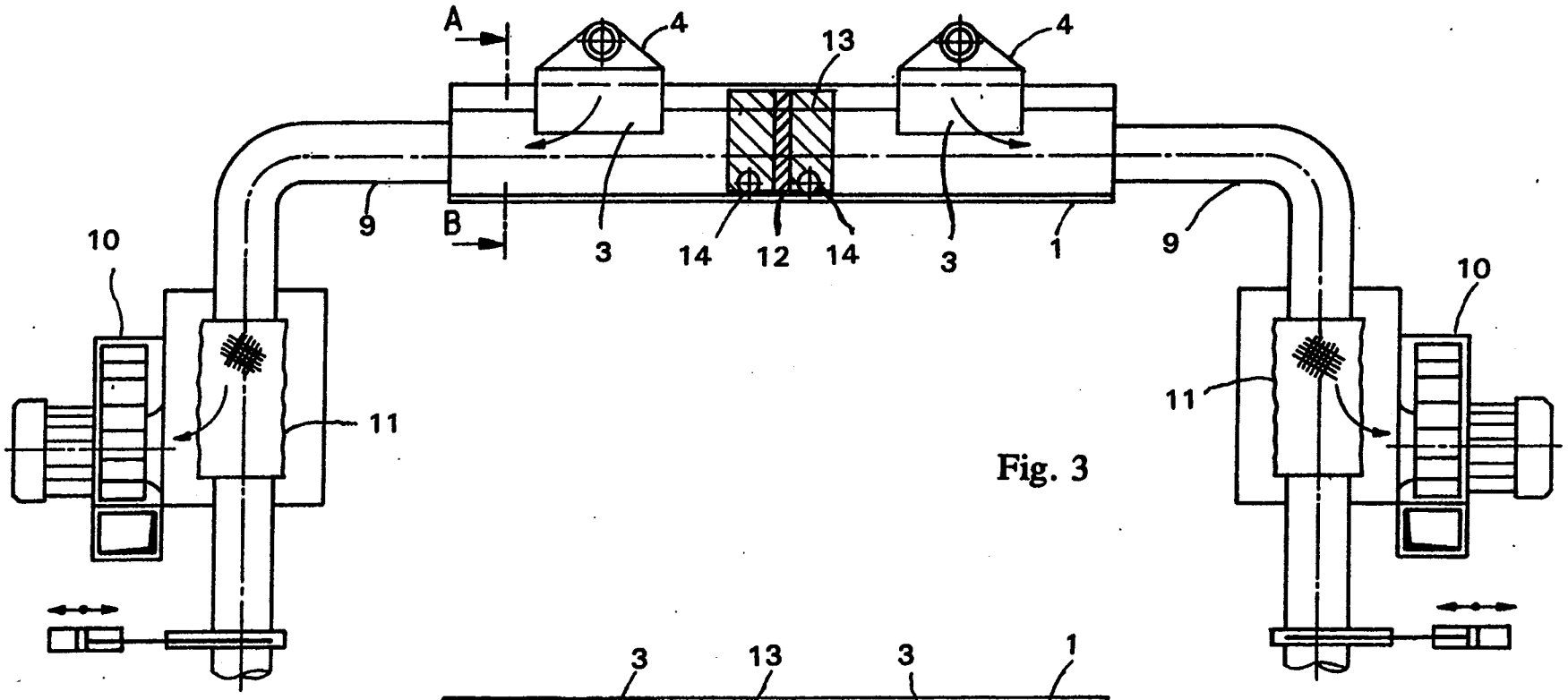
FIG. 3 is a view corresponding to FIG. 1 of a second embodiment.
Figure 4:
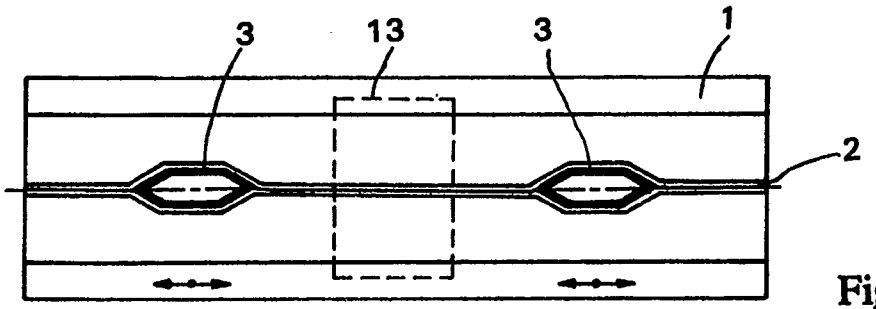
FIG. 4 is a top view corresponding to FIG. 2 of the second embodiment.

In order to keep the negative pressure conditions for the travelling cleaners 4 independent of one another, a partition 12 is provided, as shown in FIGS. 3 and 4, inside the suction duct 1, which abuts against the inside wall of the suction duct 1 so as to seal it. This partition 12 is part of a double T-frame which has rollers 14 on its underside on both sides of the partition 12, the rollers being supported on the floor of the suction duct 1. The frame 13 is movable inside the suction duct 1 when one of the travelling cleaners 4 runs against the frame 13. A left and a right duct half are thus formed each being attached to one of tile ventilators 10.

Figure 6:
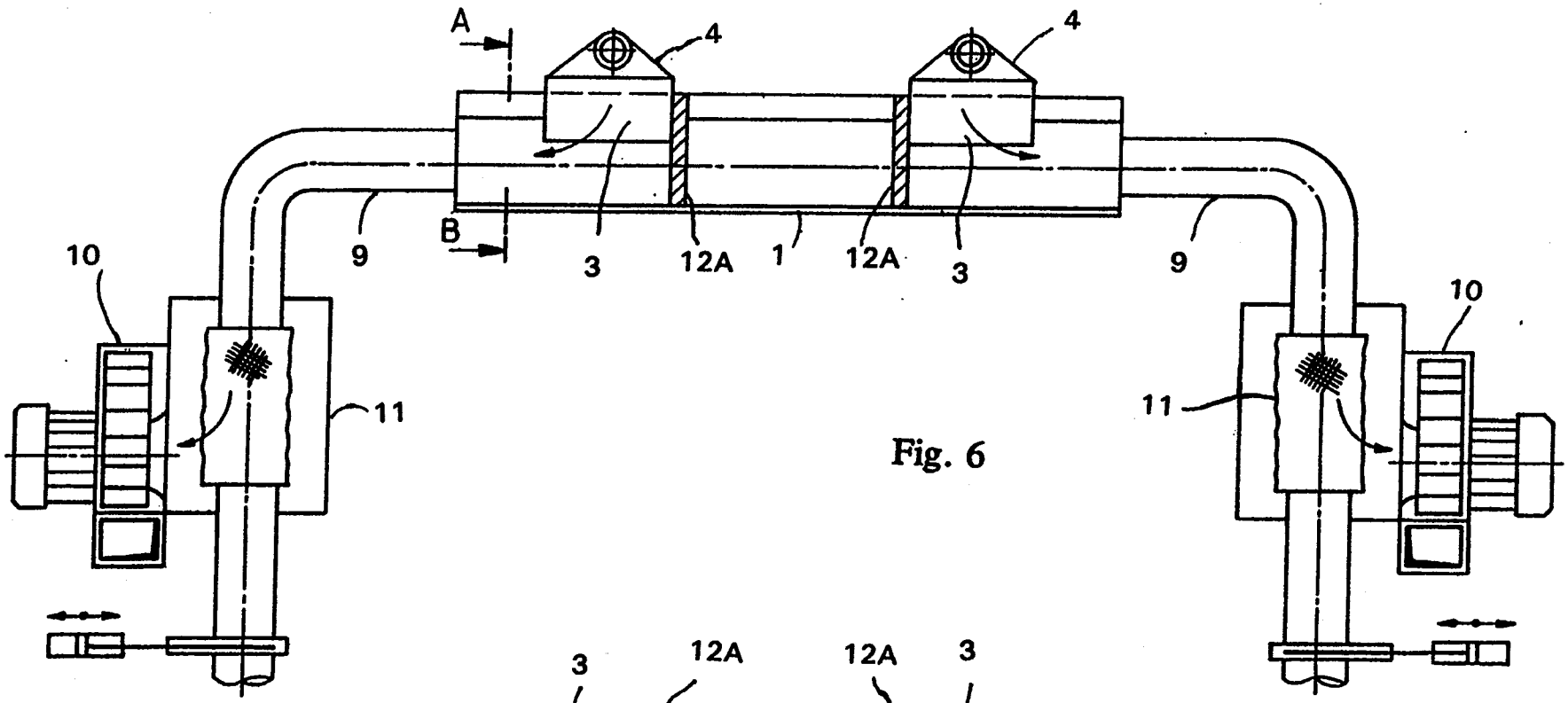
FIG. 6 is a view corresponding to FIG. 1 of a third embodiment.
Figure 7:
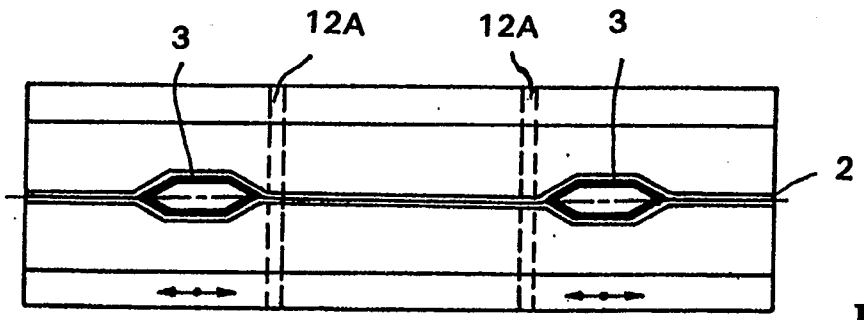
FIG. 7 is a top view corresponding to FIG. 2 of a third embodiment.

In the embodiment of FIGS. 6 and 7, each travelling cleaner 4 is provided with a partition 12A which abuts against the inside wall of the suction duct 1 so as to seal it. Partitions 12A are located at the sides of the travelling cleaners 4 facing one another and are carried along by it. Three duct sections are created in this way, whereby tile left and the right duct section are attached to tile left and right blower, respectively, whereas the duct section between the partitions 12A is pressureless.

Figure 8:
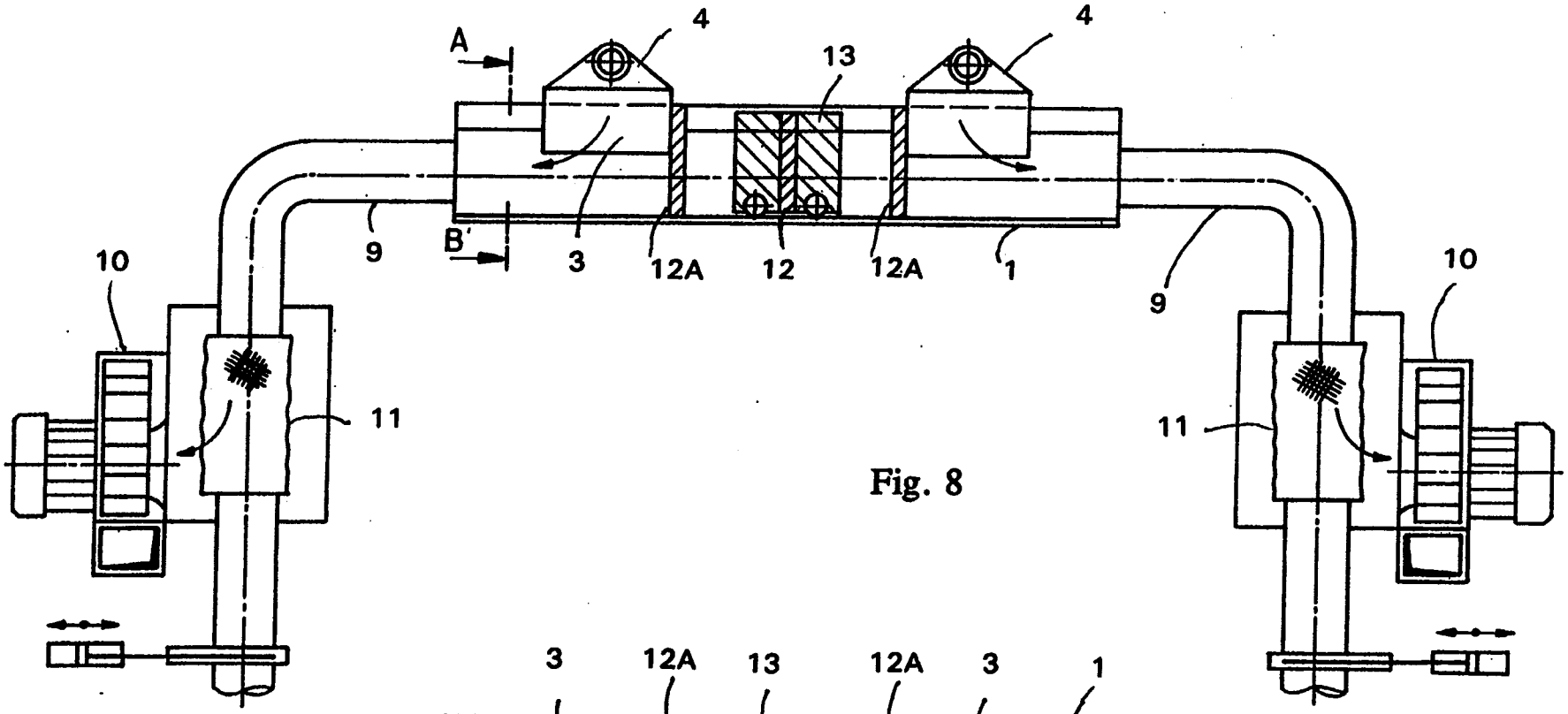
FIG. 8 is a view of a fourth embodiment.
Figure 9:
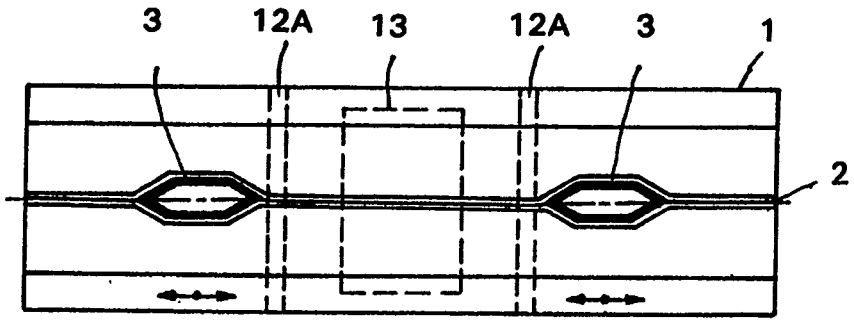
FIG. 9 is a top view corresponding to FIG. 2 of the fourth embodiment.

A combination of the second and third embodiment is illustrated in the embodiment shown in FIGS. 8 and 9. In this case, each travelling cleaner 4 has a partition 12A, whereas the movable partition 12, described with reference to FIGS. 3 and 4, is located between the partitions 12A. This embodiment is suitable, in particular, in the event that a good seal is not assured between the inside walls of the suction duct 1 and the partitions 12A.

Often, the travelling cleaners 4 clean several rows of textile machines arranged parallel to one another. In this case, it is known to provide a suction duct 1 in front of each textile machine row. At the end of a machine row, the travelling cleaner disengages from the respective suction duct, travels via rails 6 to the next machine row and engages with the suction duct located there.

Figure 11:
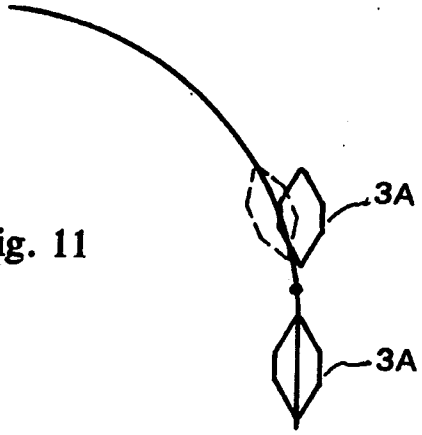
FIG. 11 is a schematic top view onto a suction nozzle construction for travelling a curved suction duct.
Figure 10:
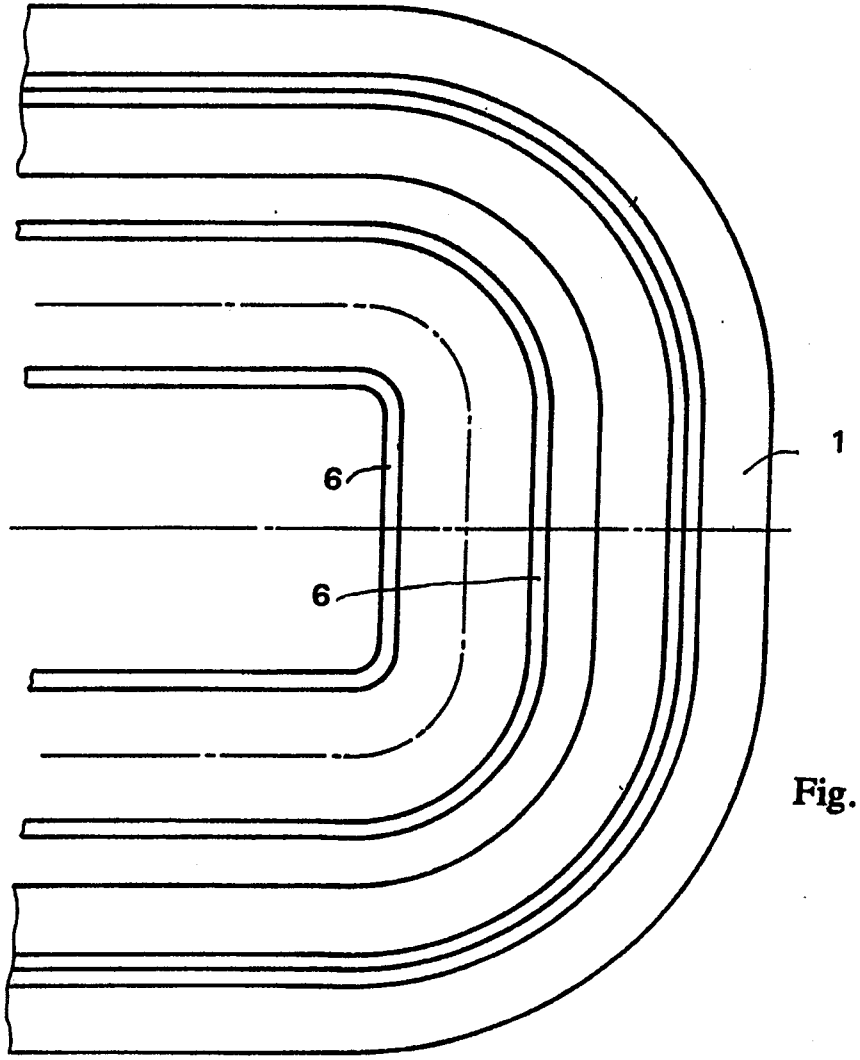
FIG. 10 is a top view onto a part of a curved suction duct.

In order to avoid this disengaging and engaging, the suction duct 1 runs, as per FIG. 10, in the shape of a curve from one machine row to the next machine row. This is similarly true for rails 6. So that the travelling cleaners can pass through the curves of the suction duct 1, two boat-shaped suction nozzles 3A end in the distributor box, the suction nozzles 3A being located behind one another as seen in direction of travel and each of these is pivoted on the distributor box 7. As shown by a broken line in FIG. 11, these suction nozzles 3A adapt to the shape of the curve.

Figure 12:
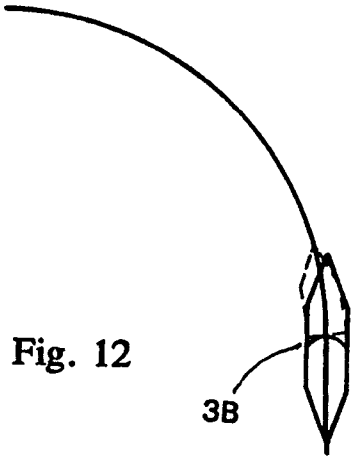
FIG. 12 is a schematic top view of a further embodiment of a suction nozzle construction.

According to the embodiment shown in FIG. 12, a suction nozzle 3B is divided into two orthogonally to the direction of travel, whereby the two parts are flexibly connected to one another. In this case also, it is possible to adapt to the shape of tile curve, as shown by the broken line. Since the area between two adjacent textile machine rows does not necessarily have to be thoroughly cleaned, it can be accepted in the curve run that the sealing lips 2 do not lie against the suction nozzles 3A, 3B in such a way that they seal completely.

I claim:

1. A cleaning system for textile machines comprising two essentially identical travelling cleaners which can travel separately from one another along a line of textile machines, each cleaner having a boat-shaped suction nozzle which engages with a stationary suction duct, two sealing lips abutting against the suction nozzle, sealing the nozzle and duct interiors with each other and from the outside atmosphere, the two essentially identical travelling cleaners engaging their suction nozzles in the suction duct, the suction duct having at least two connections at a distance from one another with which it is in fluid communication with the suction side of at least one blower.

2. A cleaning system as defined in claim 1, further comprising at least one partition which is contained within the suction duct, and located between the travelling cleaners inside the suction duct.

3. A cleaning system as defined in claim 2, wherein the at least one partition is movable.

4. A cleaning system as defined in claim 3, the partition being guided via rollers along the floor of the suction duct.

5. A cleaning system as defined in claim 3, in which the partition is provided on one of the travelling cleaners and is located on a side which faces the other travelling cleaner.

6. A cleaning system as defined in 5, in which a partition is provided on each travelling cleaner located on sides of the travelling cleaners which face each other.

7. A cleaning system as defined in claim 6, the suction side of a blower being in fluid communication with each end of the suction duct.

8. A cleaning system as defined in claim 1, the suction side of a blower being in fluid communication with each end of the suction duct.

9. A cleaning system as defined in claim 8, in which the boat-shaped suction nozzles are divided into two parts, orthogonally to the run of the sealing lips, the two suction nozzle parts being flexibly connected to one another.

10. A cleaning system as defined in claim 8, each travelling cleaner having two boat-shaped suction nozzles each of which is pivoted on a travelling cleaner.

11. A cleaning system as defined in claim 1, in which the boat-shaped suction nozzles are divided into two parts, orthogonally to the run of the sealing lips, the two suction nozzle parts being flexibly connected to one another.

12. A cleaning system as defined in claim 11, the suction duct extending in the form of a curve from one row of textile machines to another row of textile machines.

13. A cleaning system as defined in claim 1, each travelling cleaner having two boat-shaped suction nozzles each of which is pivoted on a travelling cleaner.

14. A cleaning system as defined in claim 13, the suction duct extending in the form of a curve from one row of textile machines to another row of textile machines.

* * * * *